United States Patent [19]

Eason

[11] Patent Number: 4,535,616

[45] Date of Patent: Aug. 20, 1985

[54] FLARING TOOL

[75] Inventor: Lloyd R. Eason, Concord, Mich.

[73] Assignee: Dowley Manufacturing, Inc., Spring Arbor, Mich.

[21] Appl. No.: 483,113

[22] Filed: Apr. 8, 1983

[51] Int. Cl.[3] ..... B21D 19/02; B21D 41/02

[52] U.S. Cl. ..... 72/116; 72/317; 72/481

[58] Field of Search ..... 72/115–117, 72/477, 483, 413, 317, 318, 125, 705, 481; 403/47

[56] References Cited

U.S. PATENT DOCUMENTS

| | | | |
|---|---|---|---|
| 1,765,704 | 6/1930 | Schultis | 72/117 |
| 1,795,358 | 3/1931 | Arndt | 72/125 |
| 1,846,116 | 2/1932 | Kerns | 72/125 |
| 1,985,454 | 12/1934 | McCabe | 72/117 |
| 2,117,543 | 5/1938 | Corrigan | 72/317 |
| 2,120,029 | 6/1938 | Lilleberg | 72/116 |
| 2,242,831 | 5/1941 | McIntosh | 72/317 |
| 2,430,168 | 11/1947 | Graham | 72/317 |
| 3,027,931 | 4/1962 | Franck | 72/125 |
| 3,195,337 | 7/1965 | Janik | 72/115 |
| 3,262,298 | 7/1966 | Samuels et al. | 72/125 |
| 3,575,033 | 4/1971 | Meyer, Jr. | 72/317 |
| 4,047,415 | 9/1977 | Crane et al. | 72/125 |
| 4,068,515 | 1/1978 | Kowal | 72/115 |

*Primary Examiner*—Lowell A. Larson

*Attorney, Agent, or Firm*—Beaman & Beaman

[57] ABSTRACT

A flaring tool for conduit utilizing a yoke adapted to support a holder capable of selectively accommodating various sizes of tubes and employing a threaded actuator having a torque producing handle at one end, and a flaring head at the other. The flaring head comprises an adapter removably mounted upon the actuator inner end wherein various sizes of flaring tool heads may be selectively used with the actuator permitting the tool to accommodate a plurality of flaring heads.

1 Claim, 4 Drawing Figures

FLARING TOOL

BACKGROUND OF THE INVENTION

For years, fittings and connections to copper orsteel tubing have included connections commonly known as "flared" wherein the end of the tube is outwardly flared to define a conical female surface for seating against a conical male surface. A nut mounted upon the tube forces the flared portion into engagement with the associated fitting. In the past, the flaring of tubes has been accomplished by a variety of tools, both of the manual and power type.

Conventional flaring tools may take the form shown in U.S. Pat. Nos. 1,795,358; 2,117,543 and 2,430,168. Also, it has been common to utilize a split bar arrangement for holding the tube during flaring, and such bars usually include a plurality of different size holes to accommodate standard tube sizes, such as shown in U.S. Pat. Nos, 2,242,831 and 3,575,033.

The particular form and configuration of the flare formed in the tube may vary, but in most tools the flaring is accomplished by a conical tool surface being axially forced into the tube end which flares the tube end in accordance with the configuration of the die recess formed in the holder. Thus, a single size and shape of conical tool surface can be used to flare various sizes of tubes.

However, some types of tube flaring requires a special size tool for each size of tube, and an example of such a tube flare configuration is shown in U.S. Pat. No. 4,047,415. In such instance wherein the flaring tool must be specially sized for each tube it is necessary to provide a complete flaring tool for each tube size, and as a number of standard tube sizes exist a workman must purchase a variety of flaring tools to accommodate the various sizes, and the purchase of such a plurality of tools is expensive.

It is an object of the invention to provide a flaring tool of a universal type wherein the major components of the flaring tool may be used to accommodate a plurality of tube sizes to form special tube flares and heads, and wherein only a minor portion of the tool is changed to accommodate a particular tube size.

Another object of the invention is to provide a tube flaring tool of a universal type wherein the tool includes a threaded actuator upon which an interchangeable adapter is mounted, the adapter being the only component that needs to be specially sized to a given tube.

Yet a further object of the invention is to provide a manual tube flaring tool utilizing interchangeable adapters wherein the adapters may be readily interchanged upon a threaded actuator, and effectively maintain their connection upon the actuator during use.

In the practice of the invention a yoke includes an anvil surface upon which a tube holding bar can be selectively located. A threaded bore defined in the yoke receives a threaded actuator having an outer end which includes a handle for rotating the actuator, and the actuator inner end includes a tool head for forming the tube end. The head is in the form of an adapter having a threaded stem which is received within a threaded recess defined in the actuator inner end.

The threaded connection between the adapter and the actuator permits a variety of sizes of adapters to be selectively mounted upon the actuator thereby permitting the desired size of tube forming head to be attached to the actuator, and as the adapter is relatively small, the interchangeability thereof with respect to the actuator significantly reduces the cost of having a tool capable of accommodating a variety of tube sizes.

The lead of the threads attaching the adapter to the actuator screw differ from the lead of the actuator threads wherein the rotative torque that is imposed upon the adapter during flaring does not tend to loosen the adapter with respect to the actuator.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
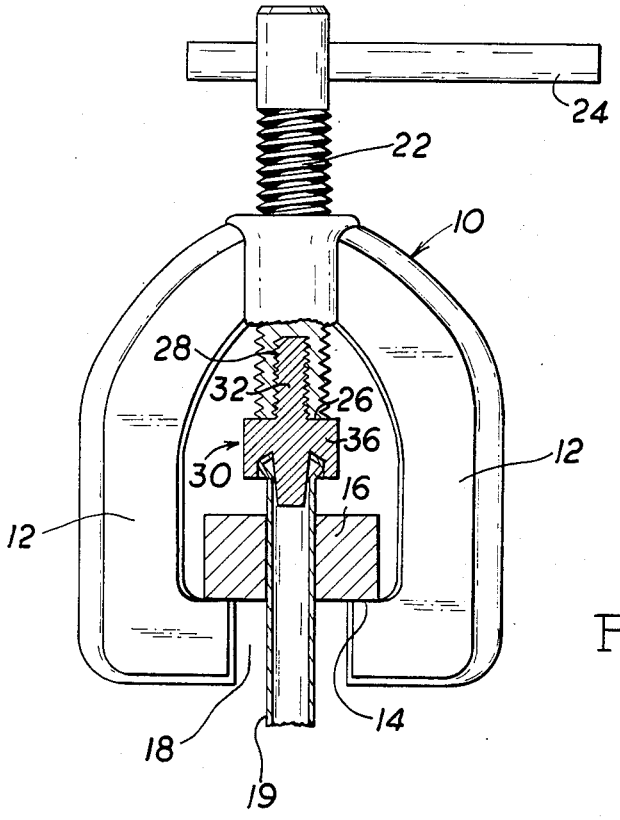
FIG. 1 is an elevational view, partially in section, illustrating a flaring tool in accord with the invention.

The tool includes a metal yoke 10 having leg portions 12 which are inwardly turned to define an aligned anvil surface 14 upon which the tube holder 16 rests. The legs 12 are sufficiently separated at 18 to permit the largest size of tube 19 to be accommodated to pass therethrough, and this clearance is in alignment with a threaded bore within the yoke which receives the threaded actuator 22.

The actuator 22 includes an outer end in which the handle 24 is received whereby torque may be manually applied to the actuator. The inner end of the actuator terminates at radial surface 26, and the actuator includes a blind threaded bore 28 intersecting the end 26.

Figure 3:
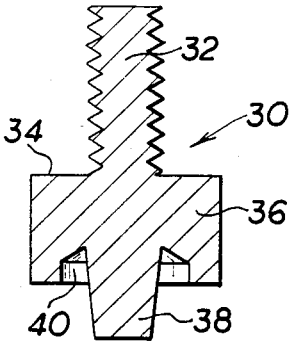
FIG. 3 is an enlarged, sectional view of an adapter, per se.
Figure 2:
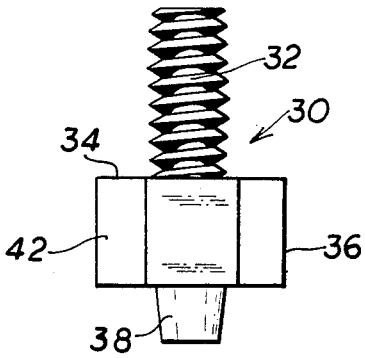
FIG. 2 is an enlarged, detail, elevational view of an adapter, per se.
Figure 4:
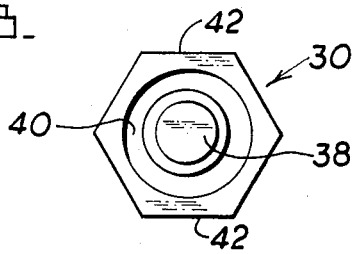
FIG. 4 is a bottom view of the adapter of FIGS. 2 and 3.

A typical adapter utilized with the flaring tool of the invention is shown in FIGS. 2–4 and this adapter 30 is preferably formed of hexagonal bar stock and includes a threaded stem 32 which cooperates with the actuator bore 28 wherein the stem may be threaded into the bore until the actuator end 26 abuts against the adapter radial shoulder 34.

The adapter includes a formed tool head 36 which includes, in the disclosed embodiment, a conical pilot and mandrel 38, and a formed annular recess 40 which will produce the desired tube flange configuration.

The adapter 30 is tightened into the actuator bore 28 by applying a wrench to the flats 42 defined upon the adapter, and as the lead of the stem threads differ from the lead of the actuator threads, torque forces imposed upon the adapter during flaring are unlikely to loosen the adapter within the actuator bore when the adapter is being "backed off" from the tube.

The tube bar holder 16 is of the general form as shown in U.S. Pat. Nos. 2,242,831 or 3,575,033, and a single bar holder is capable of accommodating a variety of tube sizes and diameters. By changing the adapters 30, the adapter size may be mounted within the actuator 22 for accommodating the tube to be worked upon, and it will be appreciated that the disclosed tool is of a universal nature wherein a plurality of tubes may be flared or headed and yet tool costs are minimized as only different adapter sizes and configurations are required.

It is appreciated that various modifications to the inventive concepts may be apparent to those skilled in the art without departing from the spirit and scope of the invention.

I claim:

1. In a flaring tool including a yoke having an anvil surface for supporting a tube holding bar and a threaded bore for receiving a threaded actuator, the thread of the bore and actuator having a given lead, the actuator having an outer end having a torque handle mounted thereon and an inner end disposed toward the yoke anvil surface, and a tube flaring head mounted upon the actuator inner end adapted to engage and flare the end of a tube held within the tube holding bar, the improvement comprising, first connection means defined upon the actuator inner end comprising a coaxial bore within the actuator intersecting the actuator inner end and first threads defined within said bore, the tube flaring head comprising an adapter, and second connection means defined upon said adapter adapted to selectively cooperate with said first connection means whereby said adapter is removably mounted upon the actuator inner end, said second connection means comprising a stem defined upon said adapter and second threads defined upon said stem, said second threads mating with said first threads, said first and second threads having a lead different from the given lead of the threads of the threaded actuator and yoke bore to prevent torque forces imposed on said adapter during rotation of the threaded actuator from loosening said adapter on the actuator during retraction.

* * * * *